US010176919B2

(12) United States Patent
Kirchner et al.

(10) Patent No.: US 10,176,919 B2
(45) Date of Patent: Jan. 8, 2019

(54) ELECTRICAL SWITCHING SYSTEM FOR A THREE-PHASE NETWORK

(71) Applicant: Maschinenfabrik Reinhausen GmbH, Regensburg (DE)

(72) Inventors: Laurenc Kirchner, Regensburg (DE); Matthias Spaeth, Regensburg (DE); Stanislav Sheiko, Dachau (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 63 days.

(21) Appl. No.: 15/037,858

(22) PCT Filed: Dec. 3, 2014

(86) PCT No.: PCT/EP2014/076383

§ 371 (c)(1),
(2) Date: May 22, 2016

(87) PCT Pub. No.: WO2015/082531

PCT Pub. Date: Jun. 11, 2015

(65) Prior Publication Data

US 2016/0293325 A1 Oct. 6, 2016

(30) Foreign Application Priority Data

Dec. 5, 2013 (DE) ..... 10 2013 113 505
Jun. 3, 2014 (DE) ..... 10 2014 107 795

(51) Int. Cl.
*H01F 29/04* (2006.01)
*H01H 9/00* (2006.01)

(52) U.S. Cl.
CPC ..... *H01F 29/04* (2013.01); *H01H 9/0016* (2013.01); *H01H 9/0044* (2013.01)

(58) Field of Classification Search
CPC ..... H01F 30/12
(Continued)

(56) References Cited

U.S. PATENT DOCUMENTS 2,998,476 A * 8/1961 Holland ..... H01F 27/06 174/139
3,374,320 A * 3/1968 Buhler ..... H01H 9/0027 200/18

(Continued)

FOREIGN PATENT DOCUMENTS

CN 202422974 U * 9/2012
DE 1249990 A 9/1967

(Continued)

OTHER PUBLICATIONS

Unknown: Advanced-Retard Switch, Jun. 30, 2005, XP002491826 pp. 1029, Maschinenfabric Reinhausen.

*Primary Examiner* — Tsz Chan
(74) *Attorney, Agent, or Firm* — Andrew Wilford

(57) ABSTRACT

An electrical system (1) for a three-phase alternating current network, comprising a transformer (20U, 20V, 20W) with a primary side (30U, 30V, 30W) and a secondary side for each phase (U, V, W) of the alternating current network;

a separate transformer housing (60U, 60V, 60W) for each transformer (20U . . . W); and a switching assembly (100) connected to the transformers (20U . . . W);

wherein the primary side (30U . . . W) and/or the secondary side has a main winding (21, 22, 23) and a regulating winding (31, 32, 33) in each phase;

the switching assembly (100) is designed such that it can connect each regulating winding (31, 32, 33) with each of the main windings (21, 22, 23); and (Continued)

the switching assembly (100) is arranged in one of the transformer housings (60U . . . W) or in an own switch housing (70).

15 Claims, 8 Drawing Sheets

(58) Field of Classification Search
USPC ..... 336/5
See application file for complete search history.

(56) References Cited

U.S. PATENT DOCUMENTS

| | | | | | |
|---|---|---|---|---|---|
| 3,590,175 | A * | 6/1971 | Bleibtreu | ..... | H01H 9/0016 200/11 TC |
| 6,856,122 | B2 * | 2/2005 | Dohnal | ..... | H01F 29/025 323/258 |
| 8,030,583 | B2 | 10/2011 | Hammer | | |
| 2010/0059356 | A1 * | 3/2010 | Hammer | ..... | H01H 1/36 200/6 R |

FOREIGN PATENT DOCUMENTS

| | | | | | |
|---|---|---|---|---|---|
| DE | 202011005058 | U | 7/2011 | | |
| EP | 0510474 | A | 10/1992 | | |
| EP | 0510474 | A1 * | 10/1992 | ..... | H01F 29/02 |

* cited by examiner

ELECTRICAL SWITCHING SYSTEM FOR A THREE-PHASE NETWORK

CROSS REFERENCE TO RELATED APPLICATIONS

This application is the US-national stage of PCT application PCT/EP2014/076383 filed 3 Dec. 2014 and claiming the priority of German patent application 102013113505.6 itself filed 5 Dec. 2013 and German patent application 102014107795.4 itself filed 3 Jun. 2014.

FIELD OF THE INVENTION

The invention relates to an electrical system for a three-phase alternating current network, to a switching assembly for using in such an electrical system, and to a method for operating a switching assembly.

BACKGROUND OF THE INVENTION

DE 20 2011 005 058 describes a transformer with a switching device. This transformer comprises a three-phase primary winding, a three-phase first secondary winding and a three-phase second secondary winding with tap adjustment. Each secondary winding has a group of three individual windings. Provided in this context are three independent switching means, by which the groups of individual windings of the first and the second secondary winding are connectable in different ways.

Due to the numerous contacts, such switching means have a complex and elaborate structure so that it presents a great challenge to put them into service properly. Furthermore, it is not only costly, but also complicated to control and operate the respective switching means separately. In addition, the installation of individual switching means takes up a particularly large amount of space in the individual transformers, making them to large for regular transport.

A switching assembly for switching one of at least three windings during transformer operation to at least one of three main windings of a phase of the transformer is known as "Advanced Retard Switch", abbreviated as ARS, from the patent applier company brochure under the title of "Advanced-Retard-Switch (ARS), Betriebsanleitung BA 274/01", imprint BA 274/0lde, 0605, published in June 2005, and is schematically illustrated in FIG. 13. At least one subassembly is provided for each phase to be switched. Arranged in each subassembly are fixed contacts for each phase to be switched. The fixed contacts are selectively switchable in each subassembly by one movable switch contact each, each of which switch contacts is fastened on a switching mechanism. This switching assembly can be used for different applications in combination with an on-load tap changer. The switching assembly is primarily used for reversing the polarity of the regulating voltage in applications with wide regulating ranges, such as phase-shifting transformers, for example. It then functions as a double reversing change-over selector.

DE 1 788 013 [U.S. Pat. No. 3,590,175] describes a tap selector for a tapped transformer with an additional change-over selector for increasing the number of possible voltage steps. In this context, the movable change-over selector contacts are each arranged in segments around the tap selector column in a support frame. By the segmented design, they can each produce a connection between a middle change-over selector contact and selectively one of two further change-over selector contacts. The support frame used here consists of a plurality of vertical insulation rods and upper and lower lever arms. This known arrangement relates to a change-over selector on a tap selector, however not to a switching assembly of the type previously mentioned and referred to as "Advanced Retard Switch".

DE 1 249 990 describes a star-point rotary off-circuit tap-changer for multi-phase tapped transformers where the fixed contacts are arranged circularly around a central off-circuit tap-changer shaft in a plurality of horizontal levels assigned to the individual phases of the transformer. This off-circuit tap-changer shaft holds the movable contacts that consist of U-shaped flat brackets that each in turn electrically conductively connect two adjacent fixed contacts. This star-point rotary off-circuit tap-changer, which serves for load-free change-over switching between winding taps, is not suited as "Advanced Retard Switch".

DE 10 2007 023 124 [U.S. Pat. No. 8,030,583] describes a switching assembly with two operating positions for change-over switching of a winding during transformer operation, where the through-current is commutated from one current path to another current path when change-over switching is carried out. In this context, fixed contacts are arranged in a plurality of horizontal levels around a rotatable switching shaft on a structure of insulation material. These contacts have upper and lower contact fingers that can be pulled apart and are switchable by an electrically conductive rail serving as movable switch contact.

OBJECT OF THE INVENTION

The object of the invention is to provide an electrical system that can be designed at a lower cost and in a more space-saving manner, and also to provide a switching assembly that is maintenance-friendly and simple to switch or to wire, as the case may be, and that has a compact construction, and to provide a method for operating a switching assembly that makes it is possible to provide safe, low-maintenance, and efficient change-over switching.

SUMMARY OF THE INVENTION

This object is achieved by with an electrical system for a three-phase alternating current network, comprising a transformer with a primary side and a secondary side for each phase of the alternating current network;

a separate transformer housing for each transformer (20U . . . W); and a switching assembly connected to the transformers;

where the primary side and/or the secondary side has a main winding and a regulating winding in each phase;

the switching assembly is designed such that it can connect each regulating winding with each of the main windings; and the switching assembly is arranged in one of the transformer housings or in an own switch housing.

This system enables a very space-saving construction. The individual transformers can be constructed particularly compact such that the transport can be carried out via regular railway tracks. In addition, the switching assembly benefits the wiring of the transformers.

Each primary side and/or each secondary side can be formed in any manner and can, for instance, comprise a main winding and a regulating winding. In the instance of one side, that is, for example, the primary side or the secondary side, comprising a main winding and a regulating winding, the other side, that is the secondary side or the primary side, can then comprise a single winding or it can also comprise a main winding and a regulating winding. Preferably, either the primary sides comprise a main winding and a regulating winding each, and the secondary sides comprise a single winding each; or the secondary sides comprise a main winding and a regulating winding each, and the primary sides comprise a single winding each.

It can be provided that at least one of the transformer housings and/or the switch housing is filled with an insulation medium.

The insulation medium can be formed in any manner and it can comprise at least one fluid, preferentially a transformer oil or an ester, for example, and/or at least one gas, preferentially SF6.

According to a second aspect of the invention there is provided a switching assembly for use in an electrical system that is designed according to the first aspect, where the switching assembly is designed for or serves for switching at least one of the regulating windings or the regulating windings to a respective one of the main windings of a phase during operation of the electrical system;

at least one subassembly is provided for each phase to be switched, in which subassembly fixed contacts are arranged;

the fixed contacts are selectively switchable in each subassembly by one movable switch contact each, each of which switch contacts is fastened on a switching mechanism; and a first electric line, a second electric line, and a third electric line conductively connects the contacts in each subassembly such that the contacts of the various subassemblies are each contacted once by the first, second, and third electric line.

According to a third aspect of the invention there is provided a switching assembly for switching one of at least three regulating windings during transformer operation to one of three main windings of a phase respectively, where at least one subassembly is provided for each phase to be switched, in which subassembly fixed contacts are arranged;

the fixed contacts are selectively switchable in each subassembly by one movable switch contact each, each of which switch contacts is fastened on a switching mechanism; and a first electric line, a second electric line, and a third electric line conductively connects the contacts in each subassembly such that the contacts of the various subassemblies are each contacted once by the first, second, and third electric line.

Each switching assembly proposed according to the second or the third aspect has a first electric line, a second electric line, and a third electric line that conductively connect the contacts in each subassembly of the switching assembly such that the contacts of the various subassemblies are each contacted by the first, second, and third electric line.

The regulating windings, which are assignable to each main winding by the respective subassemblies of the switching assembly, can be formed in any manner as required, for instance, in a linear switching, a change-over selector switching, or in a coarse/fine change-over selector switching. Each regulating winding preferentially comprises a plurality of taps, with which a fine adjustment is possible.

Each switching assembly proposed according to the second or third aspect can be used in a transformer with one main winding per each phase. It is also conceivable that a separate transformer is provided for each phase. The individual regulating windings of the corresponding main winding of the transformer are then connected to the respective phase by the subassemblies of the switching assembly.

According to a possible embodiment, a regulation can be achieved with one single movable switch contact per subassembly by each switching assembly according to the second or third switching assembly. In addition, the risk of errors due to faulty switching or, as the case may be, faulty wiring, is substantially reduced or is completely excluded, as the case may be. In a three-phase ARS, a majority of the routed cables can be replaced by bridges between the subassemblies at the ARS.

An advantage of each switching assembly proposed according to the second or third aspect is that a transformer into which the switching assembly is installed can be constructed to be substantially more compact. This leads to savings of material for the tank and also of the amount of oil in the tank. Theoretically, a greater output can be achieved with the same construction size. In addition, the complexity of the cable routing and of the switching is reduced.

Each movable switch contact can be formed in any manner as required and can comprise a copper rail, for example.

It can be provided that the first main winding is connected or can be connected with the first subassembly via hard wiring;

the second main winding is connected or can be connected with the second subassembly via hard wiring;

the third main winding is connected or can be connected with the third subassembly via hard wiring; and the first regulating winding or the second regulating winding or the third regulating winding is conductively connectable with the switching mechanism of the first main winding or of the second main winding or of the third main winding.

It can be provided that each of the three subassemblies has a conductive selector bridge connected or can be connected with the respective main winding via the wiring.

It can be provided that the first electric lines each connect one contact of each of the subassemblies, the second electric line in each case connects one contact of each of the subassemblies, and the third electric line in each case connects one contact of each of the subassemblies.

It can be provided that a common structure of insulation material of a plurality of contact bars is provided in all subassemblies and that at least some of the contact bars carry the fixed contacts.

Preferably, the contact bars are arranged around the switching shaft, with six of the contact bars carrying the fixed contacts for the subassemblies.

It can be provided that the switching mechanism comprises or is a rotatable switching shaft on which the corresponding subassemblies are centrally arranged.

Preferably, the corresponding subassemblies are arranged in series or one above the other, as the case may be, in axial direction of the rotatable switching shaft.

It can be provided that each selector bridge is an internal selector bridge that has a first arm, a second arm, and a third arm that are, in particular, set at an angle to each other; and the first arm is or can be connected with the respective main winding via the hard wiring.

Preferentially, the angle of the arms relative to each other is 120°.

It can be provided that the subassemblies are arranged one above the other in the direction of an axis of the switching shaft.

It can be provided that at least one of the switch contacts is formed to be arc-shaped.

For a rotating switching movement it is advantageous if the movable switch contact is formed to be arc-shaped.

It can be provided that at least one of the switch contacts forms a circular arc such that the switch contact contacts three consecutive contacts of the respective subassembly via contact fingers of the contacts.

Based on the size and shape of the contacts, the circular arc preferably describes an angle ranging in the area of 120°. If the form of the fixed contacts allows, a deviation of ±10° is possible.

It can be provided that the switch contact of the first subassembly is offset by 120° in a peripheral direction relative to the switch contact of the second subassembly; and the switch contact of the second subassembly is also offset by 120° in the peripheral direction relative to the switch contact of the third subassembly;

Switching or, as the case may be, wiring is particularly simple in this instance.

It can be provided that at least one of the switch contacts is fastened to a respective one contact support of insulation material, which contact support is in turn non-rotatably connected with the switching shaft.

In each electrical system proposed according to the first aspect, it can be provided that the switching assembly is designed according to the second or third aspect.

According to a fourth aspect of the invention there is provided a method for operating a switching assembly wherein a switching mechanism of a first subassembly, of a second subassembly, and of a third subassembly is moved;

a movable switch contact is arranged in each subassembly between two different and consecutive arms of a selector bridge of each of the subassemblies by moving the switching mechanism in each subassembly; and the switch contacts are arranged such that the respective main winding is electrically conductively contacted in two subassemblies via an arm of the selector bridge and via a hard wiring by moving the switching mechanism in connection with the switch contacts.

It can be provided that the switching mechanism is formed as a switching shaft;

each movable switch contact is formed to be arc-shaped; and the switching shaft is rotated such that the switch contact in each subassembly is arranged between two different and consecutive arms of the respective selector bridge.

It can be provided that the switch contact of the first subassembly is offset by 120° in a peripheral direction relative to the switch contact of the second subassembly; and the switch contact of the second subassembly is also offset by 120° in the peripheral direction relative to the switch contact of the third subassembly such that, when rotating the switching shaft, the respective main windings are electrically conductively connected in two subassemblies by the switch contact via the wiring and via an arm of the selector bridge.

In a particularly preferred embodiment where the wiring or, as the case may be, the switching of the subassemblies to each other can be carried out particularly simply, the movable and arc-shaped switch contact of a subassembly is offset in each of the subassemblies by 120° relative to the movable and arc-shaped switch contacts of the other subassemblies. Thus, the movable and arc-shaped switch contact of the first subassembly is offset by 120° in a peripheral direction relative to the movable and arc-shaped switch contact of the second subassembly. The movable and arc-shaped switch contact of the second subassembly is also offset by 120° in a peripheral direction relative to the movable and arc-shaped switch contact of the third subassembly. When the switching shaft is rotated, an arm of the selector bridge is electrically conductively connected with the respective main winding in two subassemblies by the movable and arc-shaped switch contact via the wiring or, as the case may be, via the switching.

In each method proposed according to the fourth aspect, it can be provided that the switching assembly is designed according to the second or third aspect.

The explanations and exemplifications regarding one of the aspects of the invention, in particular regarding individual features of this aspect, also apply correspondingly for the other aspects of the invention.

BRIEF DESCRIPTION OF THE DRAWING

In the following, embodiments of the invention are explained in detail by means of the attached drawings. The individual features thereof are, however, not limited to the individual embodiments but can be connected and/or combined with individual features described further above and/or with individual features of other embodiments. Each example in the illustrations is provided by explanation, not limitation of the invention. Embodiments of the invention are shown in the figures, in which.

SPECIFIC DESCRIPTION OF THE INVENTION

Figure 1:
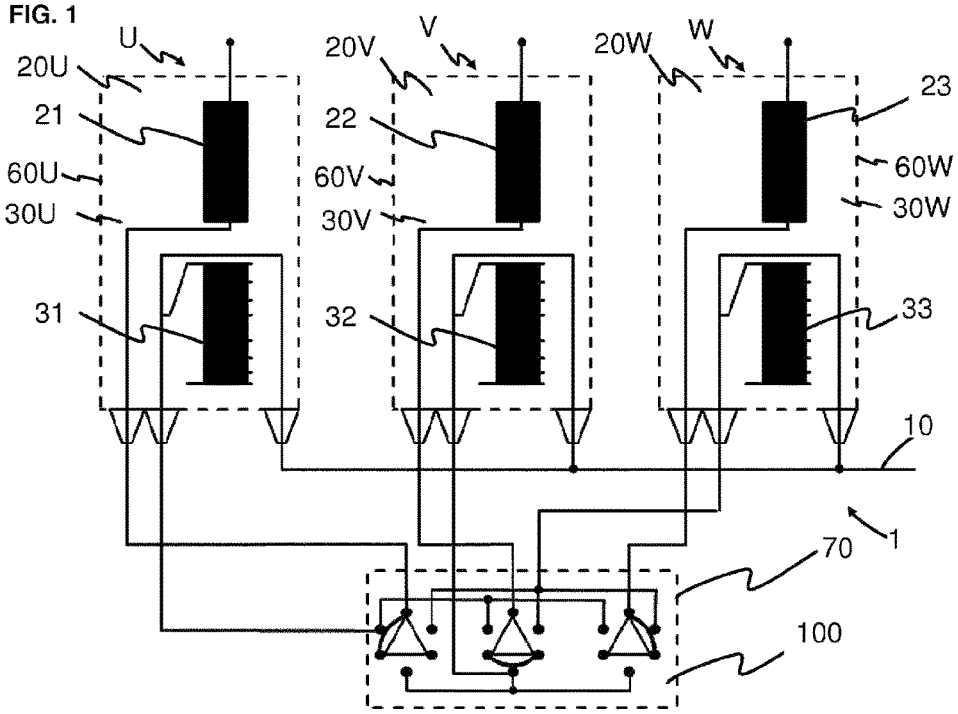
FIG. 1 shows a first embodiment of an electrical system for a three-phase alternating current network with a switching assembly.

Schematically illustrated in FIG. 1 is a first embodiment of an electrical system 1 for a three-phase alternating current network.

In this embodiment, the electrical system 1 comprises a switching assembly 100, a transformer 20U, 20V, 20W for each phase U, V, W of the alternating current network, and a separate transformer housing 60U, 60V, 60W for each transformer 20U, 20V, 20W. The primary sides 30U, 30V, 30W assigned to the phases U, V, W each comprise a main winding 21, 22, 23 and a regulating winding 31, 32, 33. By means of the switching assembly 100, the main windings 21, 22, 23 can each be individually connected in series with a regulating winding 31, 32, 33. Each regulating winding 31, 32, 33 has taps that can be switched by an on-load tap changer that is not illustrated here. A preselector, which is not illustrated here, can be arranged between each main winding 21, 22, 23 and each regulating winding 31, 32, 33. This preselector can be used for selectively adding or subtracting the regulating winding 31, 32, 33 to or from the main winding 21, 22, 23. In addition, each transformer 20U, 20V, 20W has a secondary side, which is not illustrated here, and that comprises an individual regulating winding that is galvanically separated from the primary side 30U, 30V, 30W. Arranged in each transformer housing 60U, 60V, 60W are the respective primary side 30U, 30V, 30W and the secondary side. The transformer housings 60U, 60V, 60W are exemplarily filled with an ester as liquid insulation medium.

The switching assembly 100 in this embodiment is switched with the main windings 21, 22, 23 and the regulating windings 31, 32, 33 such that each regulating winding 31, 32, 33 is selectively switchable with the assigned main winding 21, 22, 23, respectively, or with another main winding 21, 22, 23. The switching assembly 100 is arranged in a separate switch housing 70. The switch housing 70 is also exemplarily filled with an ester as liquid insulation medium. The regulating windings 31, 32, 33 are electrically conductively connected with a star point 10.

Figure 2:
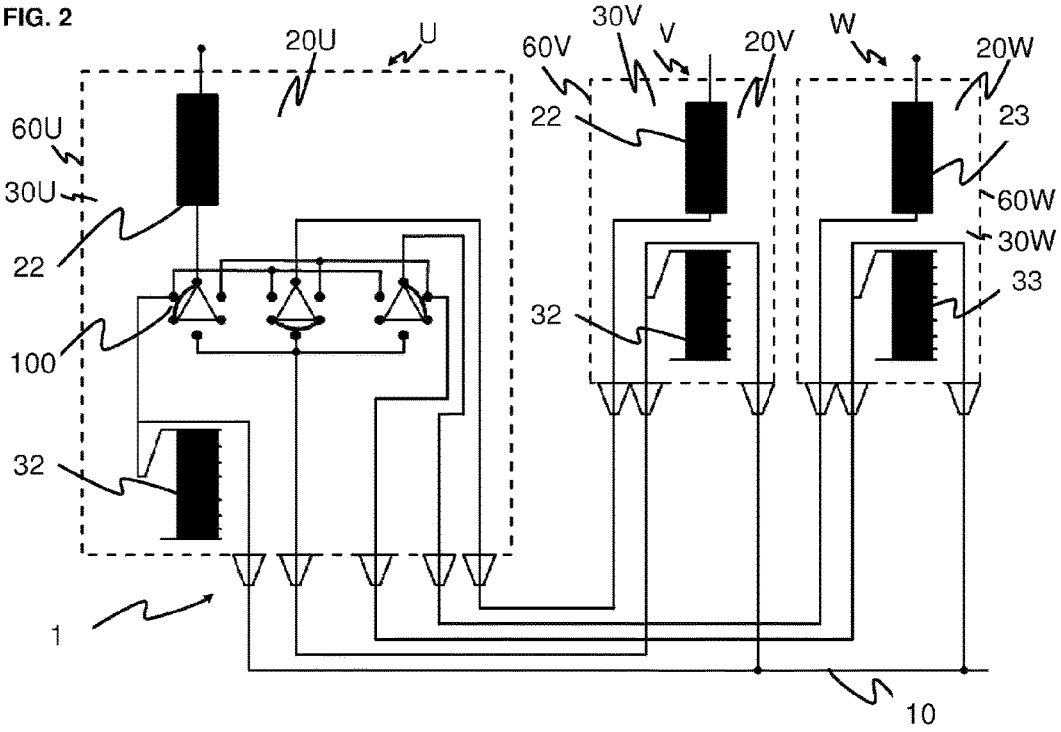
FIG. 2 shows a second embodiment of the electrical system.

A second embodiment of the electrical system 1 is schematically illustrated in FIG. 2. This second embodiment resembles the first embodiment so that primarily the differences will be explained below.

In this embodiment, the separate switch housing 70 is dispensed with, and the switching assembly 100 is exemplarily arranged in the transformer housing 60U; it can, however, also be arranged in one of the other two transformer housings 60V, 60W, as required.

Figure 3:
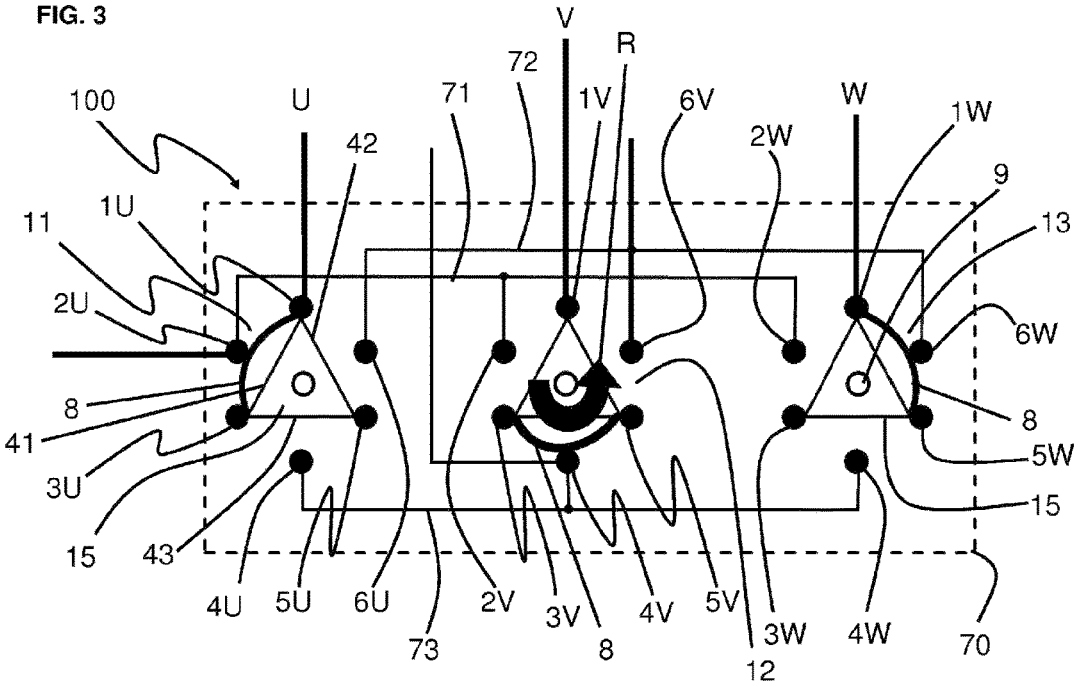
FIG. 3 shows a first embodiment of the switching assembly.

Schematically illustrated in FIG. 3 is a first embodiment of the switching assembly 100 of the electrical system 1 from FIG. 1.

The switching assembly 100 in this embodiment comprises a subassembly 11, 12, 13 for each phase U, V, W to be switched, in which subassembly 11, 12, 13 fixed contacts 1U, 1V, 1W; 2U, 2V, 2W; 3U, 3V, 3W; 4U, 4V, 4W; 5U, 5V, 5W; 6U, 6V, 6W are arranged, a movable switch contact 8 in each subassembly 11, 12, 13, a switching mechanism 9, and three electric lines 71, 72, 73.

In each subassembly 11, 12, 13, the fixed contacts 1U, . . . , 6W are each selectively switchable by an arc-shaped, movable switch contact 8 that is fastened on the switching mechanism 9. In each subassembly 11, 12, 13, the first electric line 71, the second electric line 72, and the third electric line 73 conductively connect the contacts 6W such that the contacts 6W of the various subassemblies 11, 12, 13 are each contacted once by the electric lines 71, 72, 73.

The switching assembly 100 enables a simple wiring of the subassemblies 11, 12, 13 with the first lines 71, 72, 73. By means of the switching assembly 100, it is intended and possible, as is illustrated in FIG. 1, to selectively switch a first main winding 21 of the first phase U, a second main winding 22 of the second phase V, and a third main winding 23 of the third phase W to a first regulating winding 31, a second regulating winding 32, and a third regulating winding 33 of the three transformers 20U, 20V, 20W.

In this embodiment, each of the three subassemblies 11, 12, 13 comprises a selector bridge 15 with three arms 41, 42, 43, via which the subassemblies 11, 12, 13 are electrically conductively connected with the respectively assigned main winding 21, 22, 23 via a hard wiring. Each selector bridge 15 forms a triangle, preferentially an equilateral triangle.

In FIG. 3, the switching assembly 100 is illustrated in a stationary state. The switching mechanism, which exemplarily comprises a switching shaft 9, carries one single switch contact 8 for each subassembly 11, 12, 13. In the illustrated position of this stationary state, the switch contact 8 of the first subassembly 11 contacts the fixed contacts 1U, 2U, 3U and electrically conductively connects the first regulating winding 31 with the first main winding 21 via these fixed contacts 1U, 2U, 3U and via the assigned selector bridge 15. The switch contact 8 of the second subassembly 12 in this illustrated position contacts the fixed contacts 3V, 4V, 5V and electrically conductively connects the second regulating winding 32 with the second main winding 22 via these fixed contacts 3V, 4V, 5V and via the assigned selector bridge 15. The switch contact 8 of the third subassembly 13 in this illustrated position contacts the fixed contacts 5W, 6W, 1W and electrically conductively connects the third regulating winding 33 with the third main winding 23 via these fixed contacts 5W, 6W, 1W and via the assigned selector bridge 15.

In this embodiment, the switch contact 8 of the first subassembly 11 is offset by 120° in a peripheral direction R about the switching shaft 9 relative to the switch contact 8 of the second subassembly 12. The switch contact 8 of the second subassembly 12 is also offset by 120° in the peripheral direction R relative to the switch contact 8 of the third subassembly 13.

This arrangement enables wiring the fixed contacts 1U, . . . , 6W of the subassemblies 11, 12, 13 in a way that is simple and straightforward. Wiring errors are also prevented or at least reduced.

The above-described offset of the switch contacts 8 of the subassemblies 11, 12, 13 is merely a possible embodiment and is not mandatorily required. The switch contacts 8 in the respective subassemblies 11, 12, 13 can also be arranged on the switching shaft 9 without offset. In such an instance, the lines 71, 72, and 73 correspondingly have to be switched in a different way.

Figure 4:
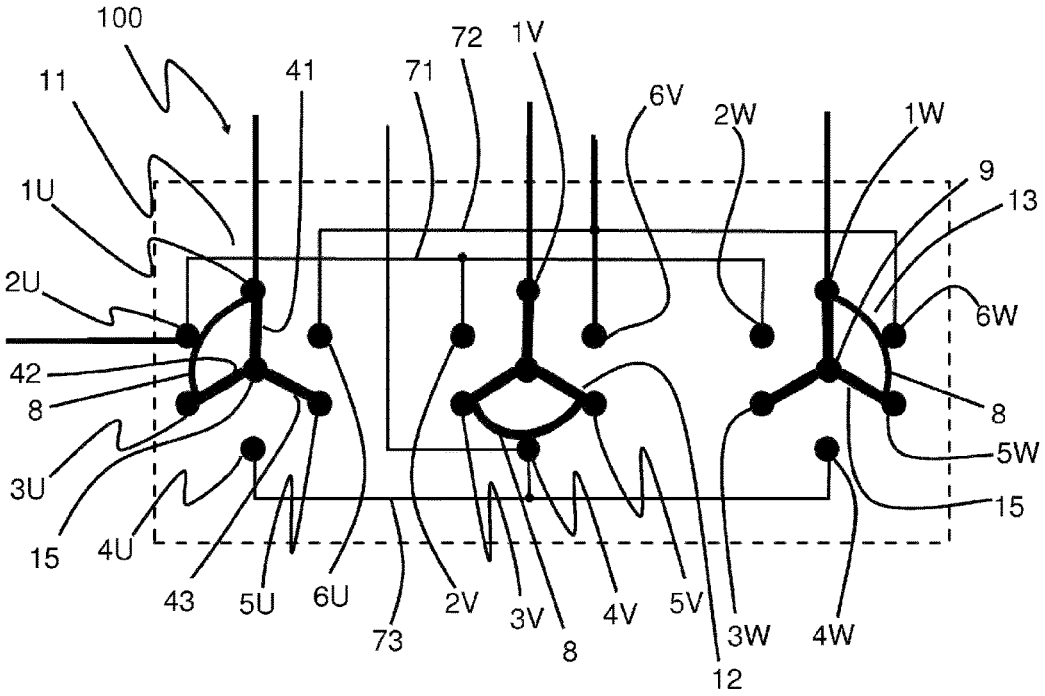
FIG. 4 shows a second embodiment of the switching assembly.

A second embodiment of the switching assembly 100 is schematically illustrated in FIG. 4. This second embodiment resembles the first embodiment so that primarily the differences will be explained below.

In this embodiment, each selector bridge 15 forms a three-pointed star.

Figure 5:
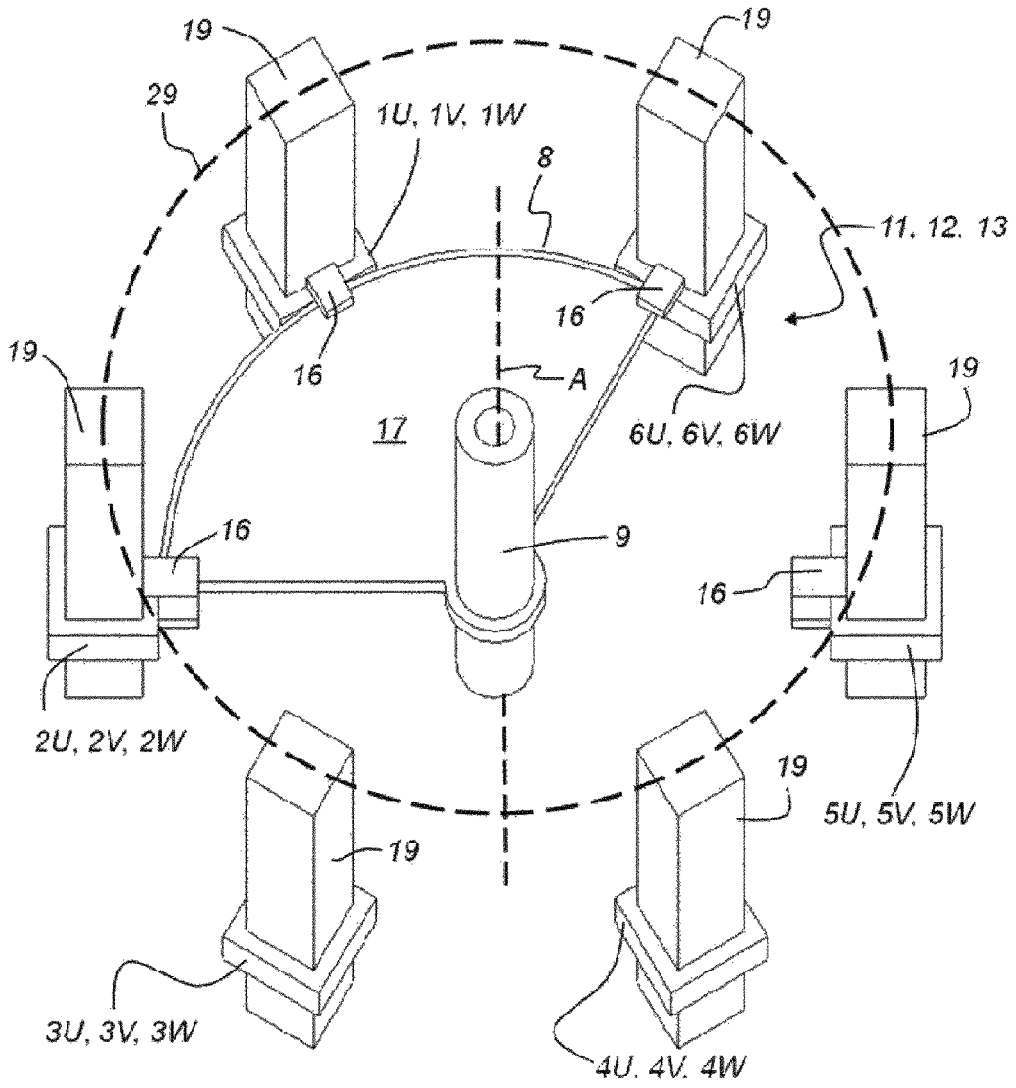
FIG. 5 shows a first embodiment of a subassembly of the switching assembly.
Figure 6:
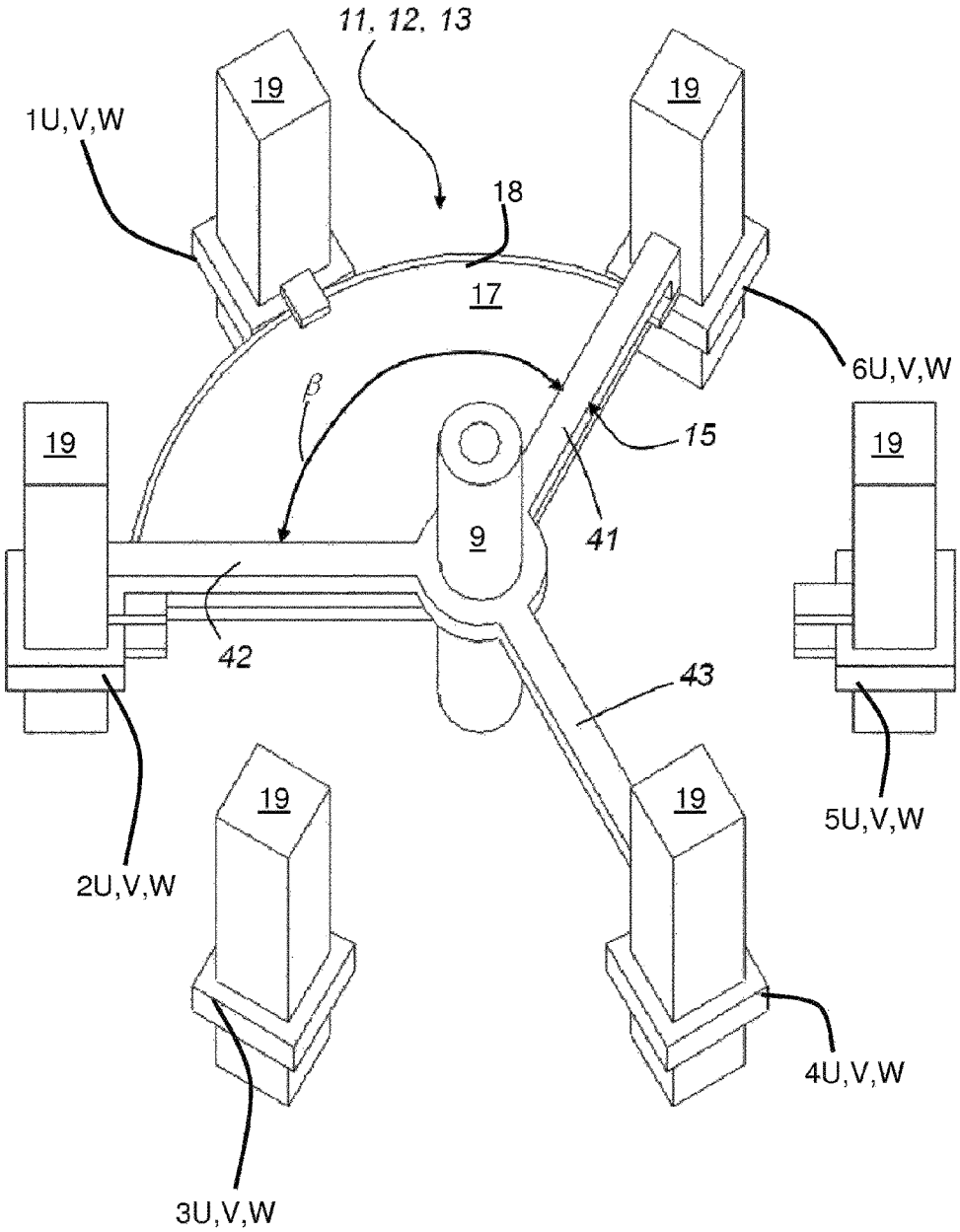
FIG. 6 shows a further view of the subassembly of the switching assembly of FIG. 5.

Schematically illustrated in FIGS. 5 and 6 is a first embodiment of one of the subassemblies 11, 12, 13 of the switching assembly 100 in a perspective view, with the selector bridge 15 not being illustrated in FIG. 5. The subassemblies 11, 12, 13 in the switching assembly 100 are arranged in the form of a switching column in direction of an axis A that corresponds to the longitudinal axis of the switching shaft 9.

In this embodiment, the subassemblies 11, 12, 13 are formed from a common structure of insulation material, which structure comprises a plurality of contact bars 19 arranged in parallel to each other. In the arrangement shown here, the contact bars 19 are arranged on a circular ring 29.

Six contact bars 19 are provided for all three subassemblies 11, 12, 13 in the embodiment illustrated here. The respective fixed contacts 1U, . . . , 6W are fastened to the six contact bars 19 at different levels that are parallel to each other. In order to improve mechanical stability, it is also possible to provide further contact bars without fixed contacts. Each subassembly 11, 12, 13 is provided for one phase U, V, W to be switched. The contact bars 19 that are still free are so-called vacant bars that serve for improving the stiffness of the entire switching assembly 100, as already mentioned above. Located centrally in the switching assembly 100, and thus in each subassembly 11, 12, 13, is the switching shaft 9 that holds a contact support 17 non-rotatably fastened to it in each subassembly 11, 12, 13. The arc-shaped switch contacts 8 are each fastened to a respective one of these contact supports 17. In this embodiment, the switch contact 8 extends along a circular arc of approximately 120° such that contact fingers 16 are each simultaneously contacted by three adjacent fixed contacts 1U, . . . , 6W in the stationary state in each subassembly 11, 12, 13, such that the adjacent fixed contacts 6W are thereby electrically conductively connected with each other.

The switching shaft 9 is operated by a drive that is not illustrated. Each switch contact 8 consists of a solid, electrically conductive material, preferably of copper. The contact bars 19 and the contact support 17 consist of an electrically insulating material.

A selector bridge 15 (FIG. 6) is provided in each of the subassemblies 11, 12, 13. In this embodiment, the selector bridge 15 comprises a first arm 41, a second arm 42, and a third arm 43. As illustrated here, these arms can be arranged as a three-pointed star in each selector bridge 15, or they can be arranged as a triangle, for instance, as shown in FIGS. 1 to 3. According to a possible embodiment, the selector bridge 15 can rotate simultaneously with the switch contact 8. The arms 41, 42, 43 are arranged at an angle β to each other and conductively connect every other fixed contact 2U, 2V, 2W; 4U, 4V, 4W; 6U, 6V, 6W with a respective one of the main windings 21, 22, 23. In the embodiment illustrated here, the angle β is 120°.

Figure 7:
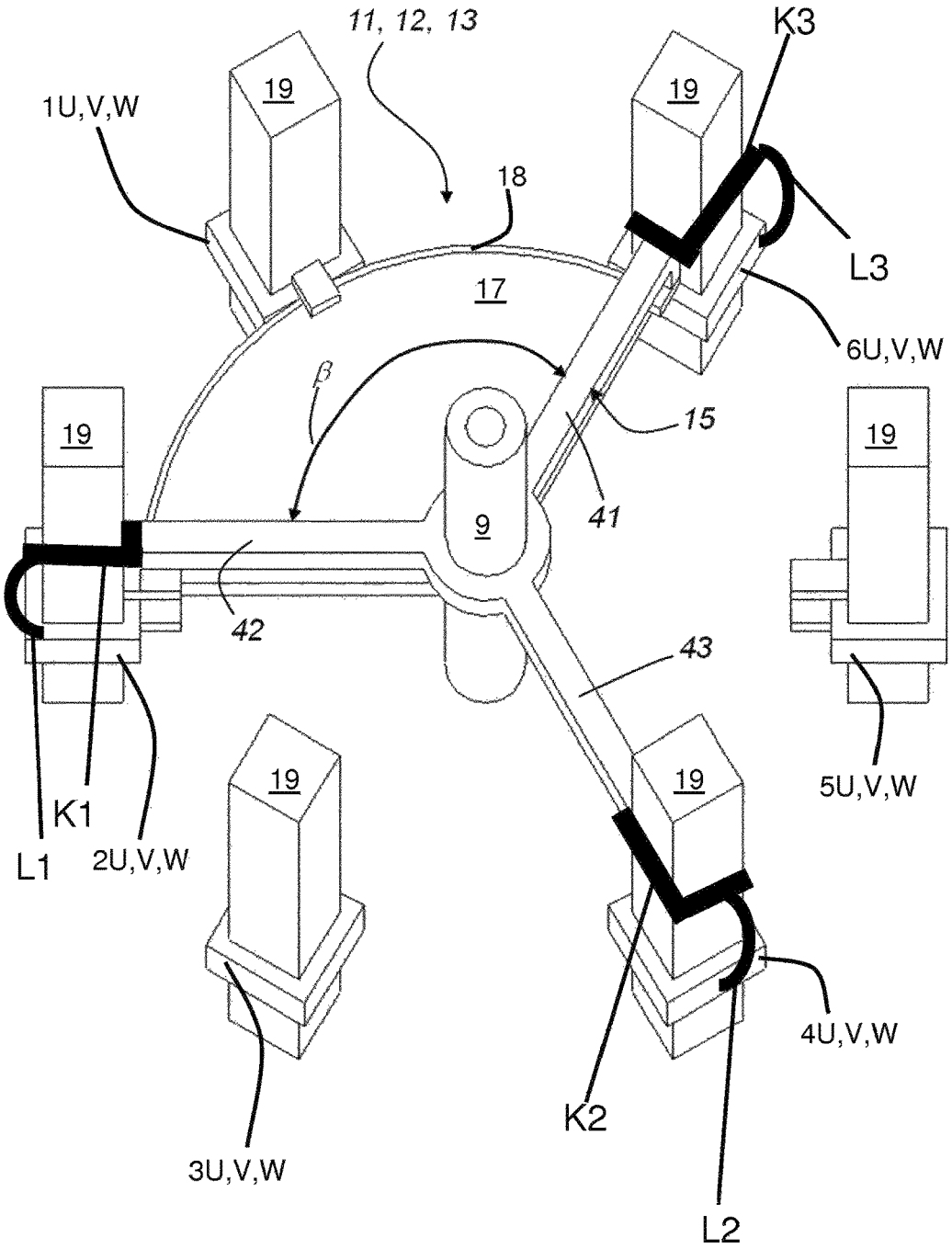
FIG. 7 shows a second embodiment of the subassembly of the switching assembly.

Schematically illustrated in FIG. 7 is a second embodiment of one of the subassemblies 11, 12, 13 of the switching assembly 100 in a perspective view. This second embodiment resembles the first embodiment so that primarily the differences will be explained below.

In this embodiment, the conductive connection between the first arm 41, the second arm 42, and the third arm 43 and the respective main windings 21, 22, 23 is realized by additional fixed contacts K1, K2, K3 in each of the subassemblies 11, 12, 13. In addition, these fixed contacts K1, K2, K3 are electrically conductively connected by connecting lines L1, L2, L3 with the fixed contacts 2U, 2V, 2W; 4U, 4V, 4W; 6U, 6V, 6W arranged on the same contact bars 19.

The main windings 21, 22, 23 and the regulating windings 31, 32, 33 of three transformers and the switching assembly 100 according to the second embodiment are schematically illustrated in different switching phases in FIGS. 8, 9, 10, 11, and 12.

Figure 8:
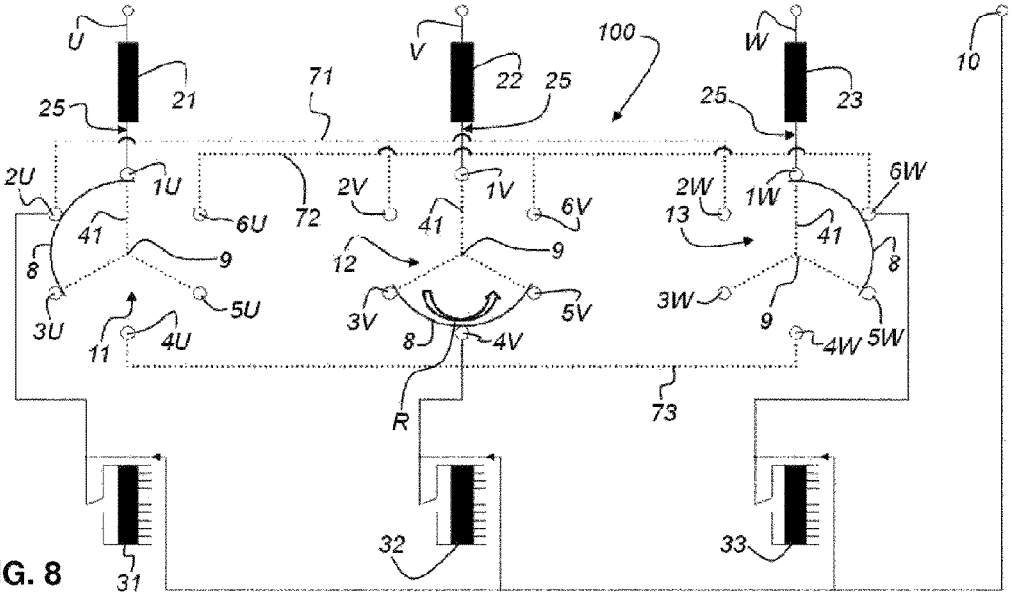
FIG. 8 shows the switching assembly according to the second embodiment in a first stationary state, which switching assembly is connected to three transformers.

FIG. 8 shows the switching assembly 100 in a first stationary state. By the switching assembly 100, it is intended to selectively switch a first main winding 21 of the first phase U, a second main winding 22 of the second phase V, and a third main winding 23 of the third phase W to a first regulating winding 31, a second regulating winding 32, and a third regulating winding 33. The regulating windings 31, 32, 33 are electrically conductively connected with a star point 10. As already mentioned above, each regulating winding 31, 32, 33 can be formed as a coarse winding or as a regulating winding.

Each of the three subassemblies 11, 12, 13 has a selector bridge 15 (see FIG. 6, 7) that, via the first arm 41 of the selector bridge 15 with the first main winding 21, the second main winding 22, and the third main windings 23 are each fixedly electrically conductively connected via a hard wiring 25 with the first subassembly 11, the second subassembly 12, or the third subassembly 13, as the case may be.

In the first stationary state of FIG. 8, the switching mechanism of the first subassembly 11, which switching mechanism is a switching shaft 9, holds a single, movable, and arc-shaped switch contact 8. In this position, the switch contact 8 contacts the fixed contacts 1U, 2U, 3U and electrically conductively connects the first regulating winding 31 with the first main winding 21. The switching shaft 9 of the second subassembly 12 also holds one single, movable, and arc-shaped switch contact 8 that contacts the fixed contacts 3V, 4V, 5V and electrically conductively connects the second regulating winding 32 with the second main winding 22 in this position. The switching shaft 9 of the third subassembly 13 also holds one single, movable, and arc-shaped switch contact 8 that contacts the fixed contacts 1W, 6W, 5W and electrically conductively connects the third regulating winding 33 with the third main winding 23 in this position.

In this embodiment, the switch contact 8 of the first subassembly 11 is offset by 120° in a peripheral direction R relative to the switch contact 8 of the second subassembly 12. The switch contact 8 of the second subassembly 12 is also offset relative to the switch contact 8 of the third subassembly 13 by 120° in the peripheral direction R. This arrangement enables wiring or, as the case may be, switching the fixed contacts 1U, . . . , 6W of the subassemblies 11, 12, 13 in a way that is simple and straightforward. Also, the occurrence of errors in the wiring or, as the case may be, in the switching is reduced or errors are avoided, as the case may be. The above-described offset of the switch contacts 8 of the respective subassemblies 11, 12, 13 is merely a possible embodiment and is not mandatorily required. The switch contacts 8 in the respective subassemblies 11, 12, 13 can also be arranged on the switching shaft 9 without offset. In such an instance, the lines 71, 72, 73 correspondingly have to be switched in a different way.

Figure 9:
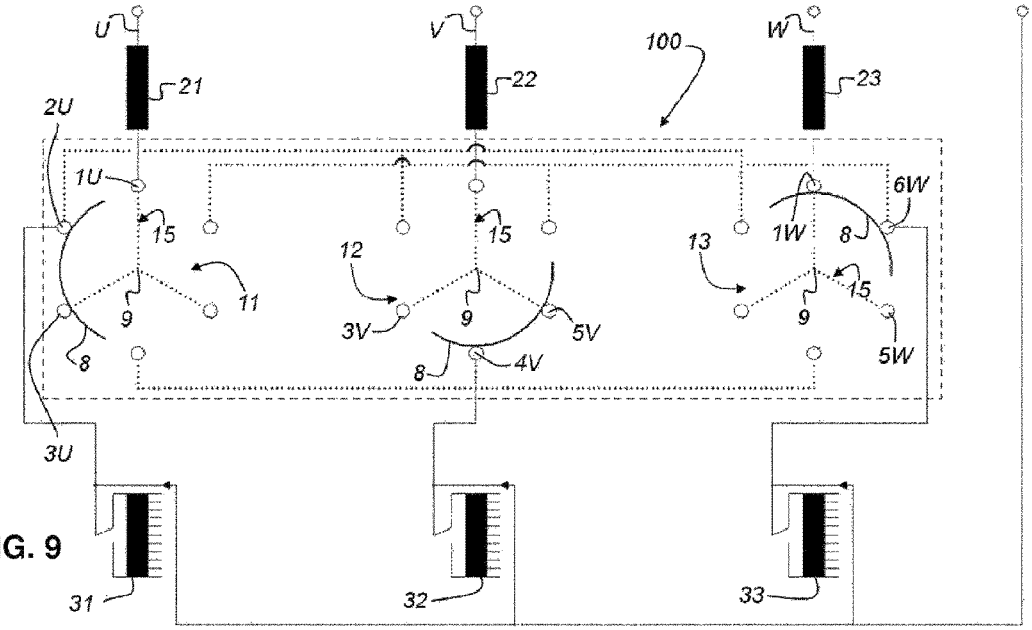
FIG. 9 shows the switching assembly of FIG. 8 in a first switching phase.
Figure 10:
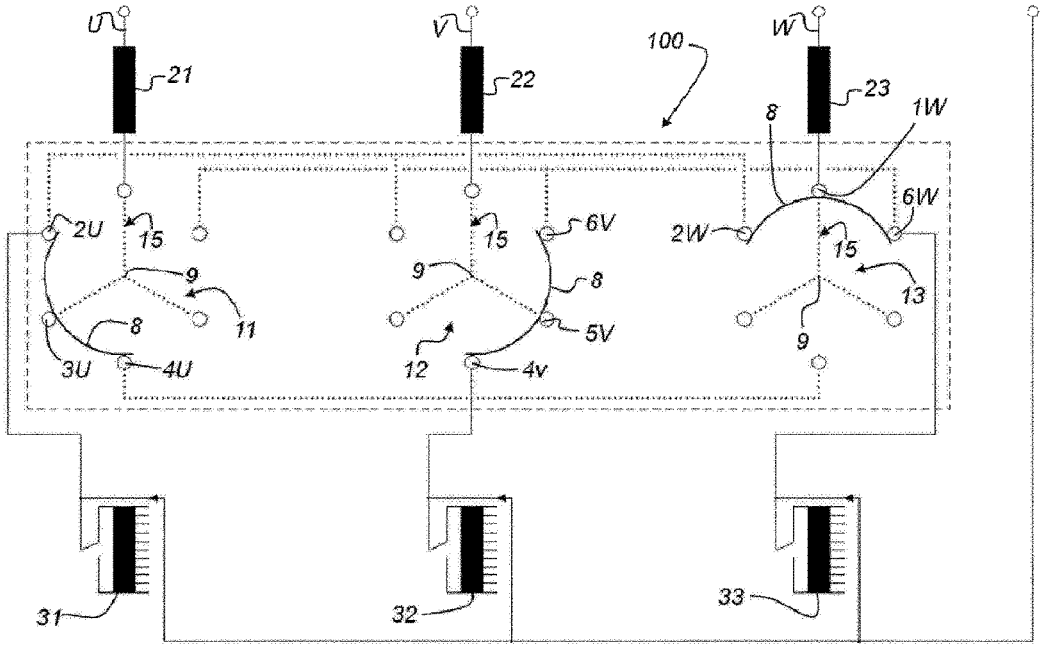
FIG. 10 shows the switching assembly of FIG. 8 in a second switching phase.
Figure 11:
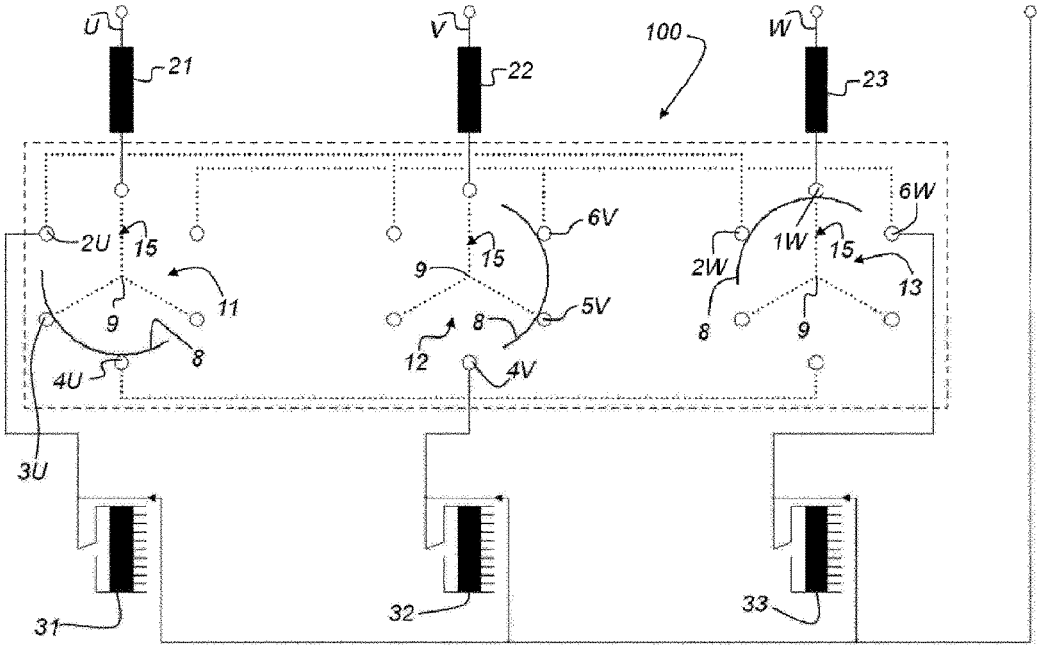
FIG. 11 shows the switching assembly of FIG. 8 in a third switching phase.
Figure 12:
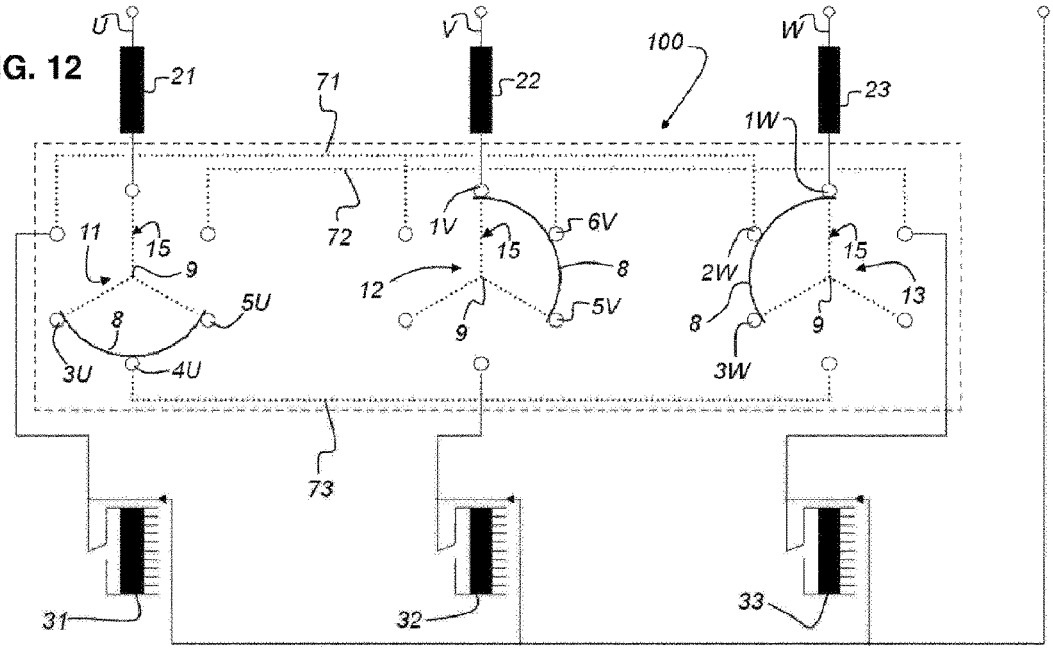
FIG. 12 shows the switching assembly of FIG. 8 in a second stationary state.
Figure 13:
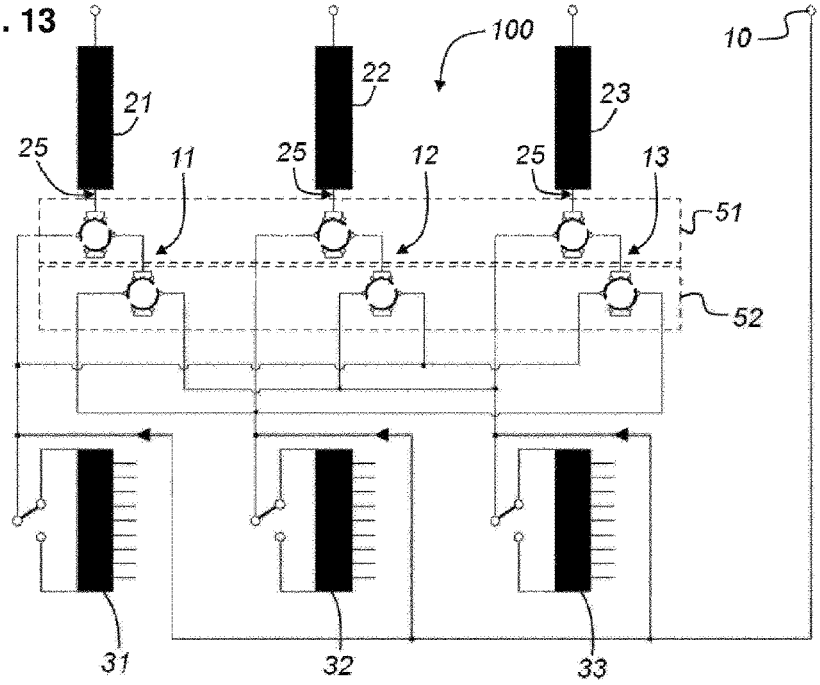
FIG. 13 shows a schematic illustration of a known switching assembly with two "Advanced Retard Switches" (ARS).

FIGS. 9 to 11 show the change-over switching from the first stationary state shown in FIG. 8 to the second stationary state shown in FIG. 12.

FIG. 9 shows the switching assembly 100 in a first switching phase. The switching shaft 9 here exemplarily rotates counter clockwise. Whether the switching shaft 9 is rotated clockwise or counter clockwise is of no significance for the invention. The range of rotation of the switching shaft 9 is 30°. In the first subassembly 11, the switching component 8 has left the first fixed contact 1U and is still contacting the second fixed contact 2U and the third fixed contact 3U. In this position of the switching component 8, the first regulating winding 31 is still connected with the first main winding 21 via the electrically conductive selector bridge 15. In the second subassembly 12, the switching component 8 has left the third fixed contact 3V and is still contacting the fourth fixed contact 4V and the fifth fixed contact 5V. In this position of the switching component 8, the second regulating winding 32 is still connected with the second main winding 22 via the electrically conductive selector bridge 15. In the third subassembly 13, the switching component 8 has left the fifth fixed contact 5W and is still contacting the sixth fixed contact 6W and the first fixed contact 1W. In this position of the switching component 8, the third regulating winding 33 is still connected with the third main winding 23 via the electrically conductive selector bridge 15.

FIG. 10 shows the switching assembly 100 in a second switching phase. The range of rotation of the switching shaft 9 is 60°. The switching shaft 9 continues to rotate counter clockwise. In the first subassembly 11, the switching component 8 now has contact with the second fixed contact 2U, the third fixed contact 3U, and the fourth fixed contact 4U. In this position of the switching component 8, the first regulating winding 31 is still connected with the first main winding 21 via the electrically conductive selector bridge 15. In the second subassembly 12, the switching component 8 now has contact with the fourth fixed contact 4V, the fifth fixed contact 5V, and the sixth fixed contact 6V. In this position of the switching component 8, the second regulating winding 32 is still connected with the second main winding 22 via the electrically conductive selector bridge 15. In the third subassembly 13, the switching component 8 now has contact with the sixth fixed contact 6W, the first fixed contact 1W, and the second fixed contact 2W. In this position of the switching component 8, the third regulating winding 33 is still connected with the third main winding 23 via the electrically conductive selector bridge 15.

FIG. 11 shows the switching assembly 100 in a third switching phase. The range of rotation of the switching shaft 9 is now 90°. The switching shaft 9 continues to rotate counter clockwise. In the first subassembly 11, the switching component 8 now has left the second fixed contact 2U and is still in contact with the third fixed contact 3U and with the fourth fixed contact 4U. In this position of the switching component 8, the first regulating winding 31 is no longer in contact with the first main winding 21. In the second subassembly 12, the switching component 8 now has left the fourth fixed contact 4V and is still in contact with the fifth fixed contact 5V and with the sixth fixed contact 6V. In this position of the switching component 8, the second regulating winding 32 is no longer in contact with the second main winding 22. In the third subassembly 13, the switching component 8 now has left the sixth fixed contact 6W and is still in contact with the first fixed contact 1W and the second fixed contact 2W. In this position of the switching component 8, the third regulating winding 33 is no longer in contact with the third main winding 23.

FIG. 12 shows the switching assembly 100 in a second stationary state as the completion of the switching phases shown in FIGS. 9 to 11. The range of rotation of the switching shaft 9 is now 120° counter clockwise. In order to achieve this second stationary state, the switching shaft 9 rotates counter clockwise by additional 30° relative to the third switching phase from FIG. 11. In the first subassembly 11, the switching component 8 now is in contact with the third fixed contact 3U, the fourth fixed contact 4U, and the fifth fixed contact 5U. In this position of the switching component 8, the second regulating winding 32 is connected with the first main winding 21 via the third electric line 73 and via the selector bridge 15. In the second subassembly 12, the switching component 8 is in contact with the fifth fixed contact 5V, the sixth fixed contact 6V, and the first fixed contact 1V. In this position of the switching component 8, the third regulating winding 33 is connected with the second main winding 22 via the second electric line 72 and via the selector bridge 15. In the third subassembly 13, the switching component 8 is in contact with the first fixed contact 1W, the second fixed contact 2W, and the third fixed contact 3W. In this position of the switching component 8, the first regulating winding 31 is connected with the third main winding 23 via the first electric line 71 and via the selector bridge 15.

The rotation of the switching shaft 9 from one stationary state to the next stationary state is intended to be carried out in one step by a continuous movement. A gradual rotation of the switching shaft 9 is possible, as is described in FIGS. 9 to 11. This would allow carrying out an inspection of the functionality of the switching shaft 9.

In the third stationary state, which is not illustrated, the switching shaft 9 has rotated by another 120°. In the first subassembly 11, the switching component 8 is in contact with the fifth fixed contact 5U, the sixth fixed contact 6U, and the first fixed contact 1U. In this position of the switching component 8, the third regulating winding 33 is connected with the first main winding 21 via the second electric line 72 and via the selector bridge 15. In the second subassembly 12, the switching component 8 is in contact with the first fixed contact 1V, the second fixed contact 2V, and the third fixed contact 3V. In this position of the switching component 8, the first regulating winding 31 is connected with the second main winding 22 via the first electric line 71 and via the selector bridge 15. In the third subassembly 13, the switching component 8 is in contact with the third fixed contact 3W, the fourth fixed contact 4W, and the fifth fixed contact 5W. In this position of the switching component 8, the second regulating winding 32 is connected with the third main winding 23 via the third electric line 72 and via the selector bridge 15.

From a present stationary state, in which the first main winding 21 is switched to the first regulating winding 31, for instance, the second main winding 22 to the second regulating winding 32, and the third main winding 23 to the third regulating winding 33, it is possible by the switching assembly 100 and by the switching or, as the case may be, by the wiring of the subassemblies 11, 12, 13, to connect each of the main windings 21, 22, 23 with the respectively adjacent regulating winding 33, 31, 32 "on the left" or the respectively adjacent regulating winding 32, 33, 31 "on the right" by selecting the rotation direction of the switching mechanism 9. The switching assembly 100 functions during transformer operation. It is not required to turn off the transformer.

The invention claimed is:

1. An electrical system for a three-phase alternating current network having first, second, and third phases, the electrical system comprising first, second, and third transformers each with a primary side and a secondary side for the respective phases of the alternating current network, each primary side or secondary side of each transformer having a main winding and a regulating winding for the respective phase;

respective separate first, second and third transformer housings holding the first, second, and third transformers; and a switching assembly connected to the transformers and designed to connect each regulating winding with the main winding of the respective transformer, the switching assembly being in one of the transformer housings or in its own switch housing;

a respective first, second, or third subassembly for the first, second and third phases to be switched, each subassembly having respective movable and fixed contacts that are selectively switchable by the respective movable switch contacts, each movable switch contact being mounted on a switching mechanism; and a first electric line, a second electric line, and a third electric line conductively connecting the contacts in each subassembly such that the fixed and movable contacts of the various subassemblies are each contacted once by the first, second, and third electric line and at least one of the regulating windings is switched to a respective one of the main windings during operation of the electrical system.

2. The electrical system according to claim 1, further comprising:

an insulation medium filling at least one of the transformer housings or the switch housing.

3. The switching assembly defined in claim 1 for switching one of the regulating windings during transformer operation to a respective one of the three main windings of a phase, the switching assembly further comprising:

a respective first, second, or third subassembly for each phase to be switched, each subassembly having respective movable and fixed contacts;

a switching mechanism carrying the movable switch contacts and engageable with the fixed contacts for electively switching same; and a first electric line, a second electric line, and a third electric line conductively connecting the fixed and movable contacts in each subassembly such that the fixed and movable contacts of the subassemblies are each contacted once by the first, second, and third electric line.

4. The switching assembly according to claim 1, further comprising:

a first wiring connecting the first main winding of the first phase with the first subassembly;

a second wiring connecting the second main winding with the second subassembly; and a third wiring connecting the third main winding with the third subassembly, the first winding or the second winding or the third winding being conductively connectable with the switching mechanism of the first main winding or of the second main winding or of the third main winding.

5. The switching assembly according to claim 1, wherein each of the three subassemblies has a conductive selector bridge connected with the respective main winding via the wiring.

6. The switching assembly according to claim 1, wherein the first electric line connects a respective contact of each of the subassemblies, the second electric line connects a respective contact of each of the subassemblies, and the third electric line connects a respective contact of each of the subassemblies.

7. The switching assembly according to claim 1, further comprising:

a common structure of insulation material of a plurality of contact bars in all of the subassemblies and at least some of the contact bars carry the fixed contacts.

8. The switching assembly according to claim 1, wherein the switching mechanism is or comprises a rotatable switching shaft on which the corresponding subassemblies are centrally arranged.

9. The switching assembly according to claim 5, wherein each selector bridge is an internal selector bridge that has a first arm, a second arm, and a third arm that are each arranged at an angle to each other; and the first arm is connected with the respective main winding via the respective wiring.

10. The switching assembly according to claim 8, wherein the subassemblies are arranged one above the other in the direction of an axis of the switching shaft.

11. The switching assembly according to claim 1, wherein each movable switch contact is arc-shaped.

12. The switching assembly according to claim 1, wherein at least one of the switch contacts forms a circular arc such that the one switch contact contacts three consecutive contacts of the respective subassembly via contact fingers of the contacts.

13. The switching assembly according to claim 8, further comprising:

a contact support at least one of the switch contacts is fastened to one contact support of insulation material that is in turn non-rotatably connected with the switching shaft.

14. An electrical system for a three-phase alternating current network having first, second, and third phases, the electrical system comprising first, second, and third transformers each with a primary side and a secondary side for the respective phases of the alternating current network, each primary side or secondary side of each transformer having a main winding and a regulating winding for the respective phase;

respective separate first, second and third transformer housings holding the first, second, and third transformers;

a switching assembly connected to the transformers and designed to connect each regulating winding with the main winding of the respective transformer, the switching assembly being in one of the transformer housings or in its own switch housing;

a respective first, second, or third subassembly for the first, second and third phases to be switched, each subassembly having respective movable and fixed contacts that are selectively switchable by the respective movable switch contacts, each movable switch contact being mounted on a switching mechanism; and a first electric line, a second electric line, and a third electric line conductively connecting the contacts in each subassembly such that the fixed and movable contacts of the various subassemblies are each contacted once by the first, second, and third electric line and at least one of the regulating windings is switched to a respective one of the main windings during operation of the electrical system, at least one of the switch contacts forming a circular arc such that the one switch contact contacts three consecutive contacts of the respective subassembly via contact fingers of the contacts, the switch contact of the first subassembly being offset angularly by 120° to the switch contact of the second subassembly and the switch contact of the second subassembly being also offset angularly by 120° to the switch contact of the third subassembly.

15. A method of operating a switching assembly comprising the steps of:

moving a switching mechanism of a first subassembly, of a second subassembly, and of a third subassembly;

positioning a movable switch contact in each subassembly between two different and consecutive arms of a selector bridge of each of the subassemblies by moving the switching mechanism in each subassembly; and orienting the switch contacts such that the respective main winding is electrically conductively contacted in two subassemblies via an arm of the selector bridge and via a wiring by moving the switching mechanism in connection with the switch contacts, the switching mechanism is a switching shaft, each movable switch contact arcuate;

rotating the switching shaft such that the switch contact in each subassembly is between two different and consecutive arms of the respective selector bridge, the switching mechanism being a switching shaft, each movable switch contact being arcuate; and rotating the switching shaft such that the switch contact in each subassembly is between two different and consecutive arms of the respective selector bridge, the switch contact of the first subassembly being offset angularly by 120° to the switch contact of the second subassembly and the switch contact of the second subassembly also being offset angularly by 120° to the switch contact of the third subassembly such that, when rotating the switching shaft, the respective main windings are electrically conductively connected in two subassemblies by the switch contact via the wiring and via an arm of the selector bridge.

* * * * *